United States Patent [19]

Doyle

[11] Patent Number: 4,587,768

[45] Date of Patent: May 13, 1986

[54] APPARATUS AND METHOD FOR POLISHING ENDS OF FIBER OPTICS

[75] Inventor: Ralph R. Doyle, Arlington Heights, Ill.

[73] Assignee: Buehler Ltd., Lake Bluff, Ill.

[21] Appl. No.: 604,898

[22] Filed: Apr. 27, 1984

Related U.S. Application Data

[63] Continuation-in-part of Ser. No. 555,806, Nov. 28, 1983, abandoned.

[51] Int. Cl.[4] ..... B24B 7/00

[52] U.S. Cl. ..... 51/124 R; 51/165.77; 51/165.9; 51/354

[58] Field of Search ..... 51/124 R, 165.77, 165.9, 51/354

[56] References Cited

U.S. PATENT DOCUMENTS

| | | | |
|---|---|---|---|
| 1,086,743 | 2/1914 | Abbott | 51/124 R |
| 1,177,699 | 4/1916 | Hanus | 51/165.9 |
| 2,358,269 | 9/1944 | Wemhoner | 51/165.9 |
| 2,371,085 | 3/1945 | Waters | 51/165.9 |

FOREIGN PATENT DOCUMENTS

| | | | |
|---|---|---|---|
| 383880 | 10/1923 | Fed. Rep. of Germany | 51/124 R |
| 958588 | 9/1949 | France | 51/124 R |

*Primary Examiner*—Frederick R. Schmidt
*Assistant Examiner*—J. T. Zatarga
*Attorney, Agent, or Firm*—Charles F. Pigott, Jr.

[57] ABSTRACT

A method and apparatus for polishing the ends of fiber optic connectors by gripping an end to be polished and yieldingly urging it against a moving abrasive member in a manner so as to gradually build up the force between the fiber optic end and the abrasive member from an initial low force to a maximum force.

17 Claims, 6 Drawing Figures

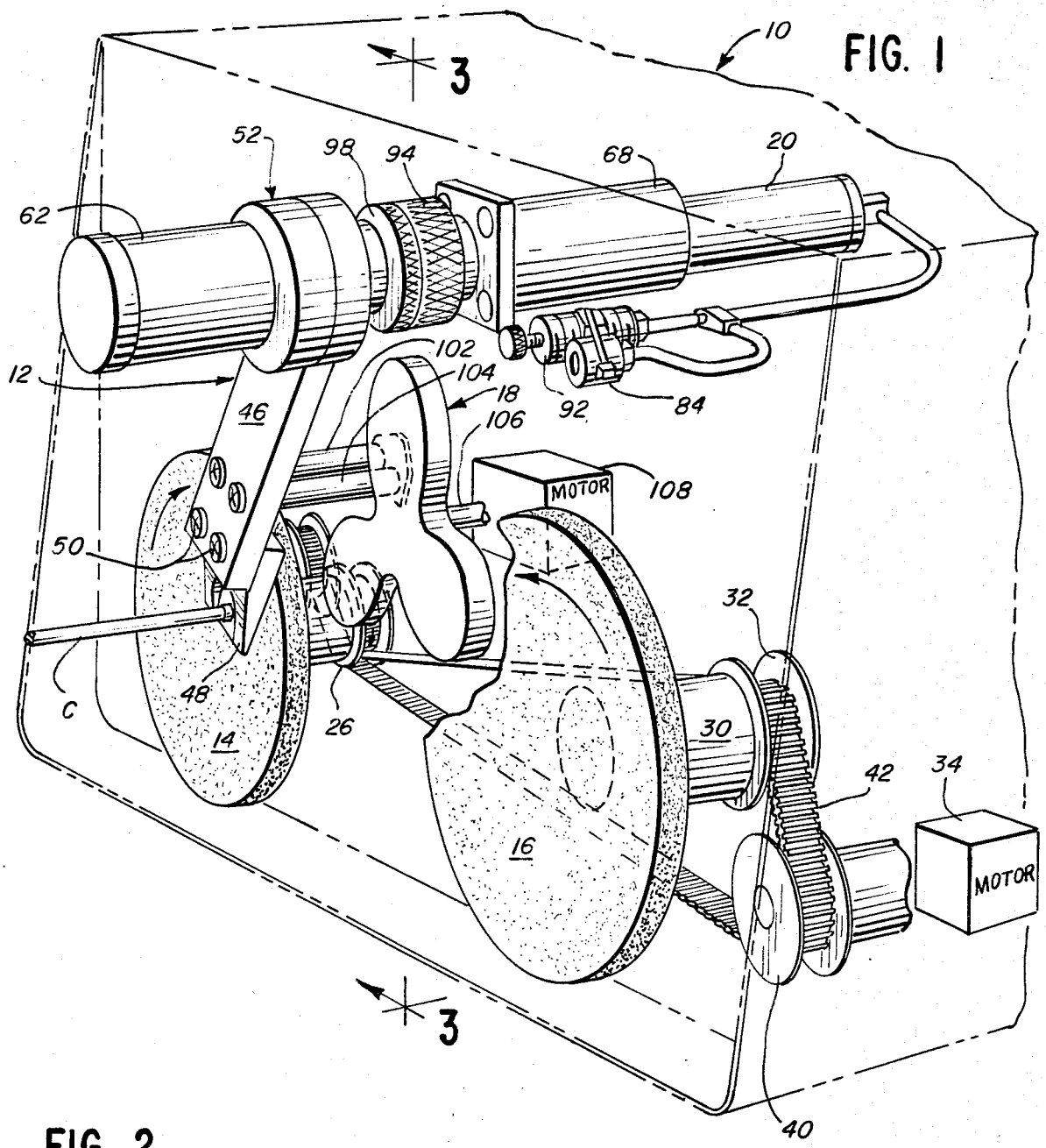
FIG. 1
FIG. 2
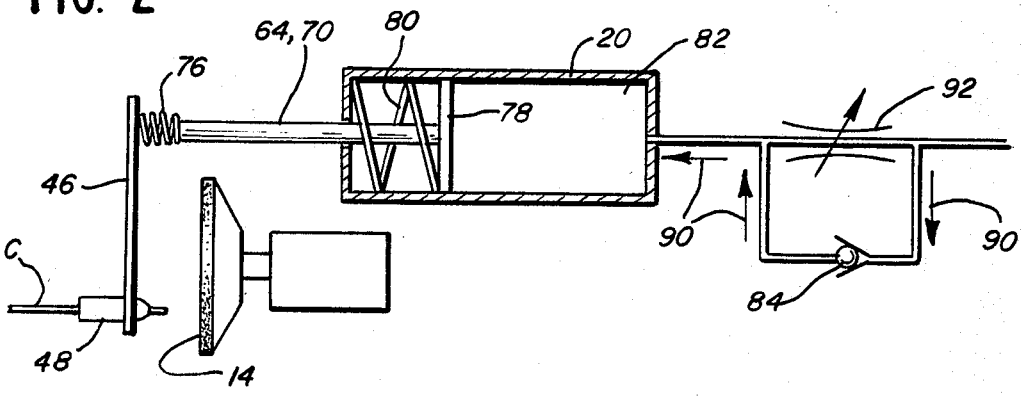

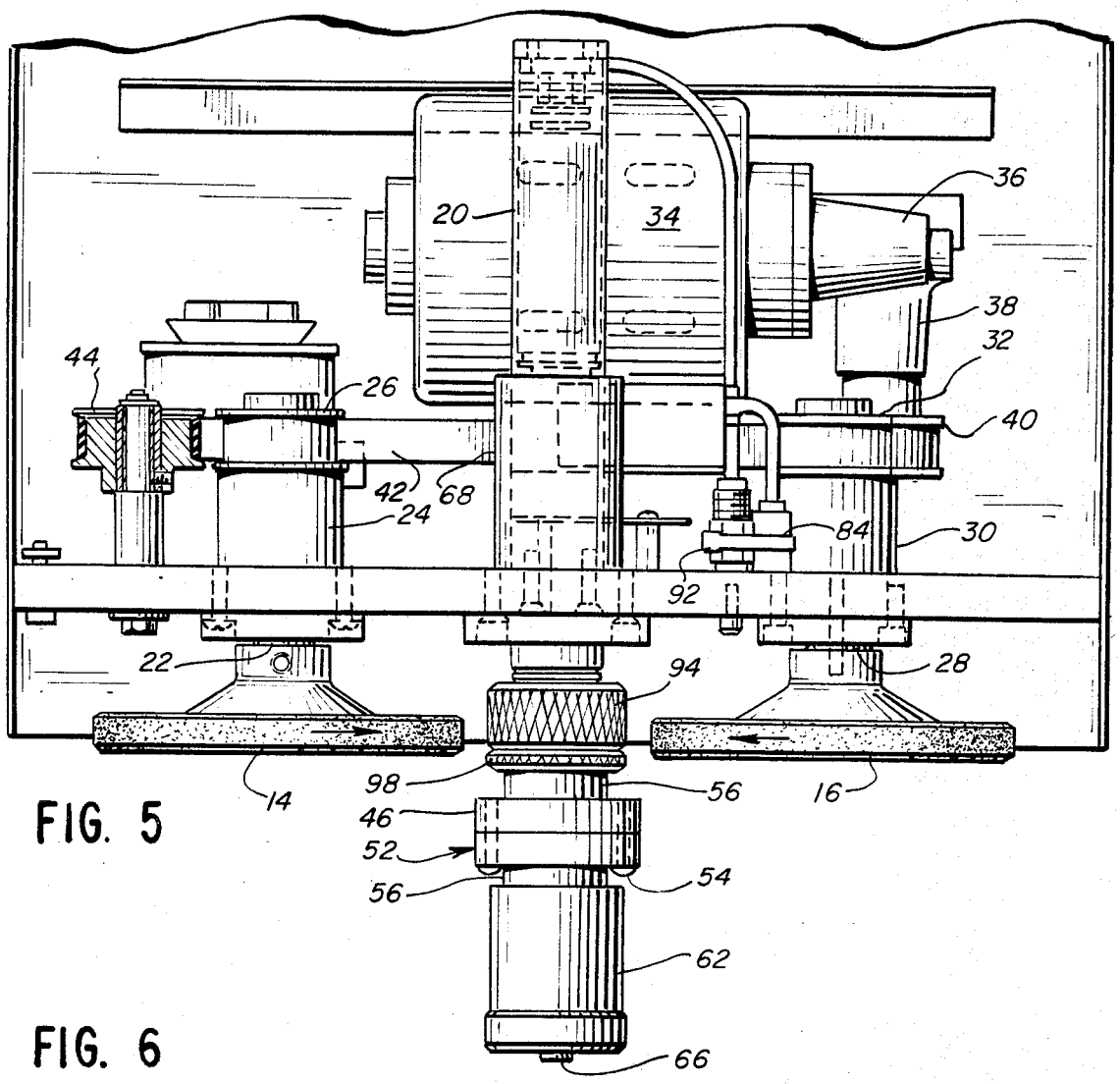
FIG. 5
FIG. 6
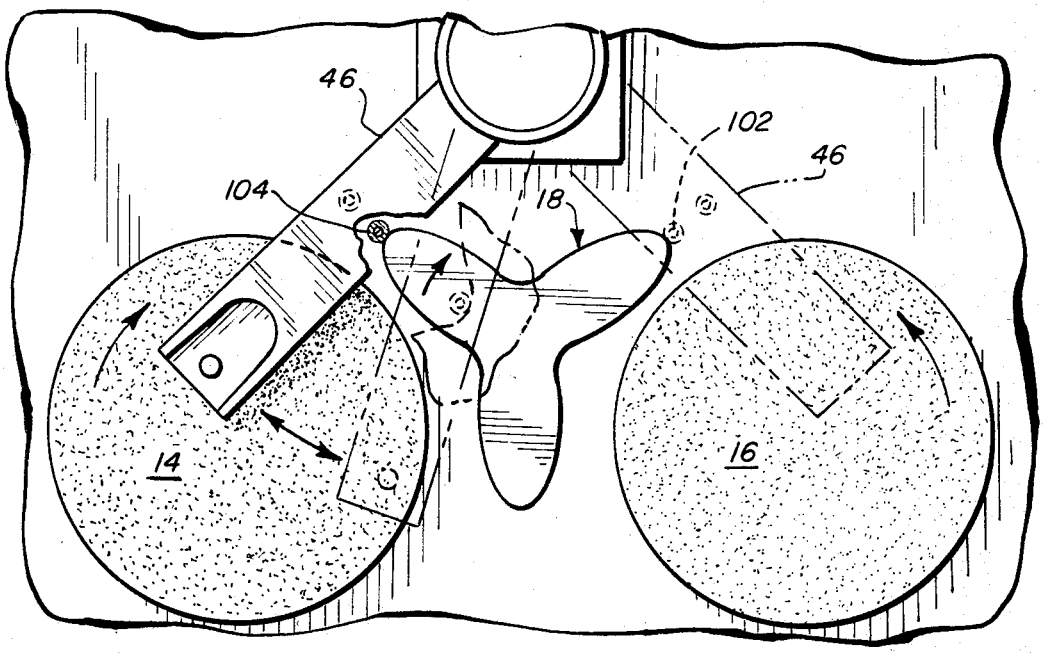

APPARATUS AND METHOD FOR POLISHING ENDS OF FIBER OPTICS

DESCRIPTION OF RELATED APPLICATION

This application is a continuation-in-part of Doyle U.S. patent application, Ser. No. 555,806, Apparatus and Method For Polishing Ends of Fiber Optics, filed Nov. 28, 1983, now abandoned.

BRIEF SUMMARY OF THE INVENTION

Fiber optic cables have gained increased use in a number of applications, as in computer interconnection, process controls, industrial automation, data transmission links and communications in general. Fiber optic members generally contain one or more glass cores which are clad with layers of cladding material for protection and strength. A cable assembly is typically sold in separate predetermined lengths which are interconnected through end-to-end contact. Such connections often must be made in the field. It is important that fiber optic ends be polished in order to minimize loss of a light signal when the ends are connected in end-to-end relation.

It is important to use considerable care in the polishing of the ends of fiber optic cable because the core in which the light signal passes is a glass or silica substance, and contact of such material with an abrasive surface can shatter or otherwise damage the fiber optic element. Such a problem is especially acute in the field where a length of cable has been scored and broken to form a rough surface requiring a polishing operation before an end-to-end connection can be made.

It has not heretofore been possible to polish the ends of fiber optic cable in an effective manner without serious risk of damage to the cable during the polishing operation.

It is therefore an object of my invention to provide a method and apparatus for polishing the ends of fiber optic cable without subjecting such cable to a serious risk of shattering or other damage during the polishing operation.

It is another object of my invention to provide a method and apparatus for polishing the ends of fiber optic cables by holding the end of such a cable against a moving abrasive member and gradually building up the pressure between the fiber optic end and the abrasive member from an initial low pressure to a maximum pressure at the end of the polishing operation.

The foregoing and other objects and advantages of my invention will be apparent from the following description of a preferred embodiment, taken in conjunction with the accompanying drawings.

DESCRIPTION OF THE DRAWINGS

FIG. 1 is a fragmentary prespective view of apparatus for polishing the end of a fiber optic cable in accordance with the present invention;

FIG. 2 is a schematic view showing apparatus for controlling the pressure between a fiber optic cable end being polished and a rotatable abrasive polishing member;

FIG. 5 is a plan view looking substantially in the direction of the arrows 5—5 of FIG. 3; and FIG. 6 is a fragmentary front elevational view, partly broken away, showing the relationship between a polishing arm and a cam member for driving the same.

Figure 3:
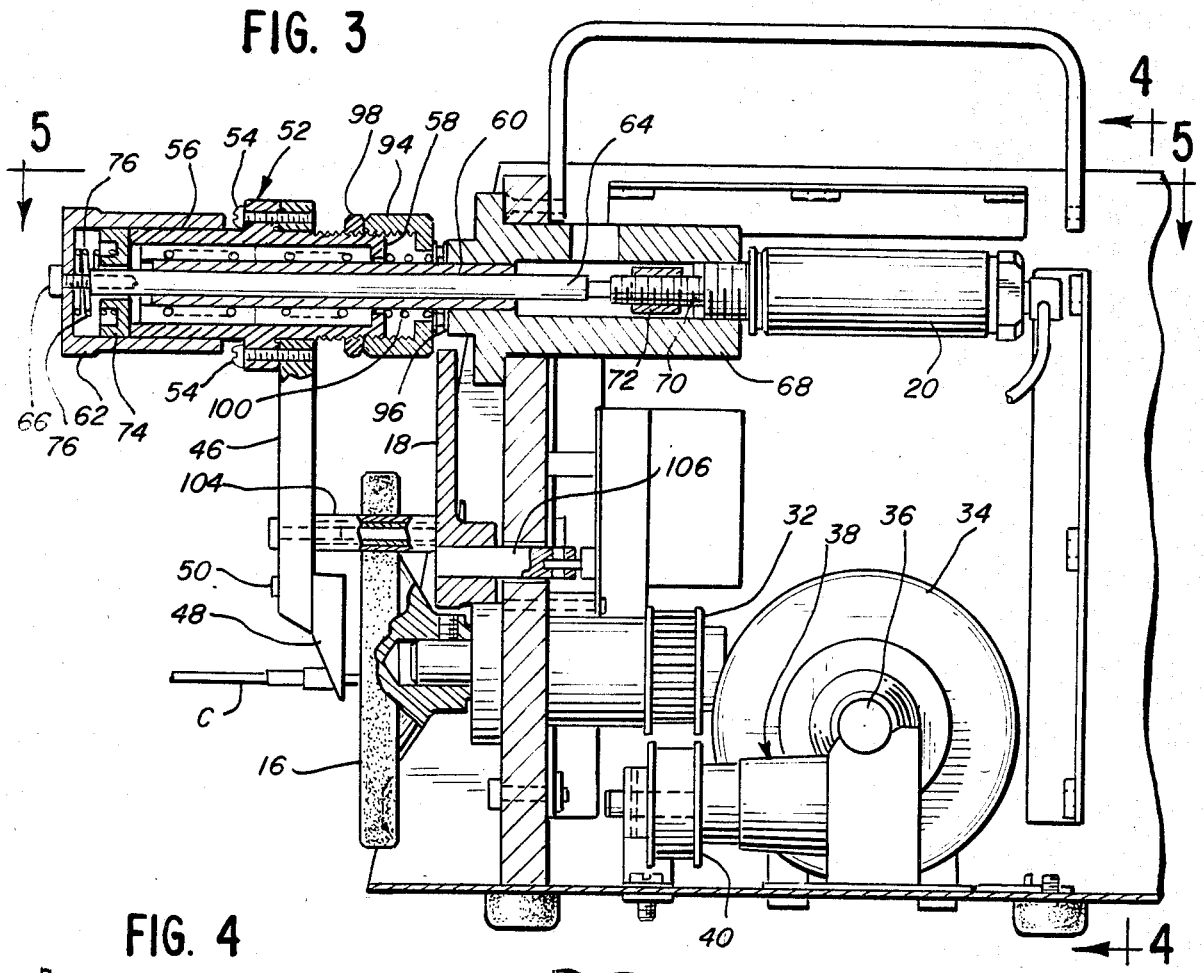
FIG. 3 is a vertical sectional view taken substantially along the line 3—3 of FIG. 1.

Now, in order to acquaint those skilled in the art with the manner of making and using my invention, I shall describe, in conjunction with the accompanying drawings, a preferred embodiment of the invention.

DETAILED DESCRIPTION OF THE INVENTION

Referring now to the drawings, FIG. 1 shows polishing apparatus 10 including a polishing arm 12 for holding the end of a fiber optic cable C against the surface of a rotatable abrasive platen 14 for polishing the end of the optic core of the cable. A second rotatable platen 16 is provided, so that one of the two platens may be used for a rough polishing operation and the other for a final polishing operation, as will be described more fully hereinafter. A rotatable cam 18 is provided for effecting oscillation of the polishing arm 12 back and forth across the front of a selected platen 14 or 16, and an air cylinder 20 is provided for controlling the axial force by which the arm 12 presses the end of the optic cable against one of the abrasive platens during a polishing operation.

The abrasive platens 14 and 16 are preferably rotated in opposite directions, as shown by the arrows in FIG. 1, for a reason which will be explained hereinafter. While the present invention may be practiced with a single abrasive platen, it is preferred to provide two such platens so that one may be provided with a rougher abrasive surface and used for a rough polishing operation, and the second provided with a finer abrasive surface and used for a final polishing operation. In a manner to be explained later herein, it is a simple matter to transfer the fiber optic cable end from a position in front of one of the two platens to a position in front of the other platen.

Figure 4:
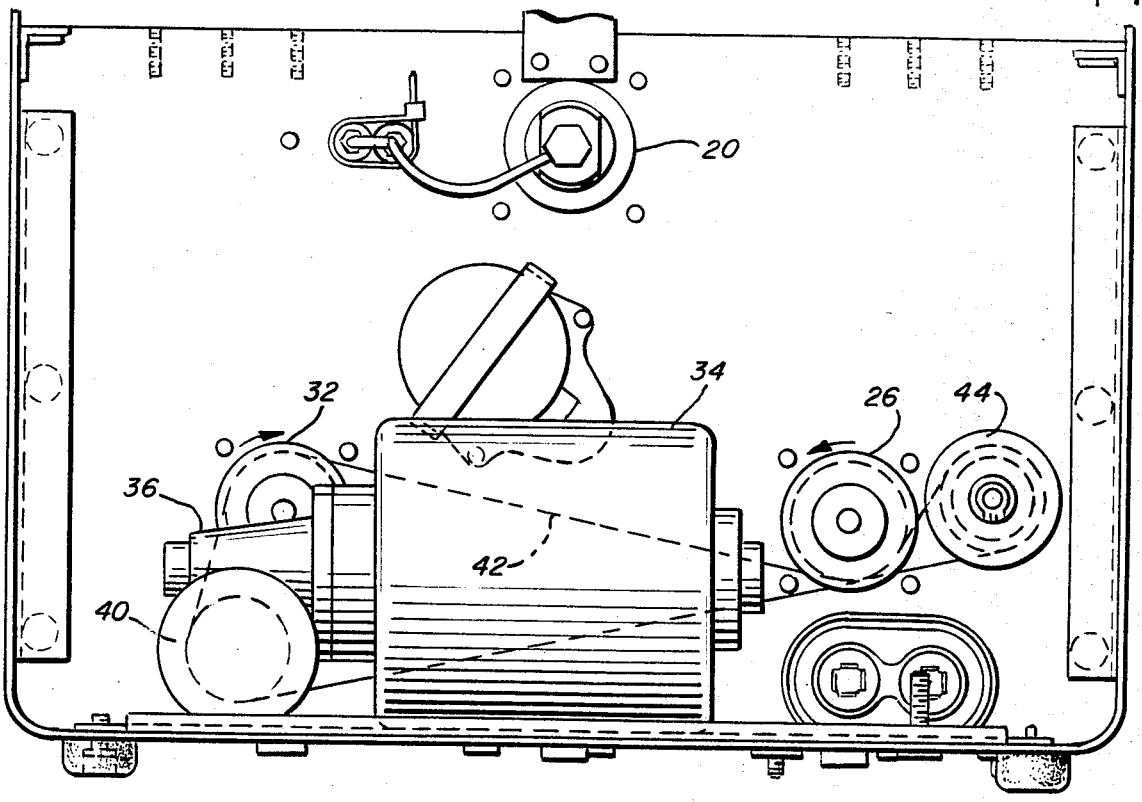
FIG. 4 is a vertical sectional view taken substantially along the line 4—4 of FIG. 3.

FIG. 5 shows the platen 14 mounted on a rotatable spindle 22 which projects from a housing 24 and is driven from a pulley 26 mounted on the spindle at the rear of the housing. In a similar manner, platen 16 is mounted on a rotatable spindle 28 which projects from a housing 30 and is driven from a pulley 32 mounted on the spindle at the rear of the housing. The pulleys 26 and 32 are driven from a fixed or a variable speed motor 34, the output of which acts through a gear housing 36, 38 to power a drive pulley shown at 40 in FIG. 4. As shown in FIG. 4, drive pulley 40 drives a belt 42 which is trained over platen pulley 32, platen pulley 26, and an idler pulley 44. It will be seen from the rear view of FIG. 4, the pulleys 26 and 32 are rotated in opposite directions as shown by the arrows. In the foregoing manner, the motor 34 rotates the abrasive platens 14 and 16 in the directions shown by the arrows in FIGS. 1 and 6.

Having described the means for rotating the abrasive platens 14 and 16, I will now describe the apparatus for holding the end of a fiber optic cable against the abrasive face of a selected one of the two platens for polishing the fiber optic end. FIG. 1 shows the polishing arm 12 which includes an arm 46 having a fixture 48 secured to its end by a pair of fasteners 50. The fixture 48 is designed to releasably hold the end of a fiber optic cable C so that a portion of such end projects toward the face of one of the abrasive platens 14 and 16, whereby when the arm 46 is moved toward the platen, the end of the fiber optic cable C will engage and be held against the face of the platen for a polishing operation.

The polishing arm 46 is connected to an arm housing 52 by fasteners 54 as best shown in FIG. 3. The housing 52 includes a sleeve or cylindrical portion 56 having a radially inwardly directed flange 58 at its right-hand end which slides on a tubular guide bearing 60. A feed control knob 62 fits over the left-hand end of the sleeve 56, and a feed control rod 64 extends through the inside of the tubular guide bearing 60. A screw 66 extends through the left-hand end of the knob 62 and is threaded into the end of rod 64 to connect the knob 62 to the end of control rod 64. It will thus be understood that pulling on the knob 62 to the left as viewed in FIG. 3 will cause the control rod 64 to move to the left, as will be described more fully hereinafter.

FIGS. 1 and 3 show the air cylinder 20 which serves to control the force by which an end of a fiber optic cable C is held against one of the platens 14 and 16 during a polishing operation. The air cylinder 20 has one end mounted in a housing 68, and a piston rod 70 projects from the left end of cylinder 20 and is connected through a coupling 72 to the right-hand end of control rod 64.

The operation of the air cylinder 20 will now be described. An operator initiates a polishing operation by pulling the control rod 64 to the left as viewed in FIG. 3. Such movement may be accomplished by pulling on the knob 62, but it is preferred to pull on the arm housing 52 so as to prevent any accidental swinging movement of the polishing arm 46. As the arm housing 52 is moved to the left, the left end of the housing sleeve 56 will act through a spring guide 74 and compression float spring 76 to engage and move the knob 62, thereby pulling control rod 64 to the left.

FIG. 2 is a schematic diagram showing that when the control rod 64 and piston rod 70 are moved to the left, a piston 78 is moved to the left so as to compress a spring 80 and increase the volume of space 82 so as to create a suction which causes air at atmospheric pressure to be drawn into chamber 82 through one-way valve 84, such air flowing in the direction of the arrows shown at 90. After pulling the rod 64 to the left to fully compress spring 80 within the cylinder 20, arm housing 52 is released to permit compressed spring 80 to move the rod 64 back to a right-hand position. As the rod 64 moves to the right, taking with it the polishing arm 46, the end of the optic cable C is first brought into contact with one of the abrasive platens 14 or 16, and is then forced against the platen to remove material from the optic cable end and thereby grind or polish the same.

The present invention includes means for providing a gradual build-up of the force by which the optic cable end is pressed against one of the rotatable abrasive platens. The spring 80 is designed to provide a desired maximum force which is achieved by a predetermined time after the end of the optic cable C is first engaged against the abrasive platen. It would not be desirable to achieve such a maximum force when the optic cable end first engages the platen, as this could cause shattering or other damage to the cable end. As a result, there is provided a variable orifice exhaust port shown at 92 in FIG. 2 which controls the rate at which the spring 80 is permitted to move the piston 78 to the right, since air cannot be exhausted from the chamber 82 through one-way valve 84. By setting the variable orifice 92, it is possible to control the rate of speed by which the optic cable end is forced into the abrasive platen, i.e., the rate of material removal.

When variable orifice 92 is closed down, piston 78 and polishing arm 46 move back to the right more slowly, and as a result the force applied at the optic cable end increases at a slower rate to a maximum force which is developed when an adjustable stop shown at 94 in FIG. 3 engages against the left-hand end 96 of the housing 68 which functions as a fixed stop to prevent further movement of arm 46 toward one of the platens 14 or 16.

The adjustable stop 94 is threaded over the right-hand end of the sleeve 56 to adjust the axial stroke or length of movement of arm 46. When stop 94 is threaded more to the left as viewed in FIG. 3, the axial stroke of rod 64 and arm 46 is increased, and when stop 94 is threaded more to the right relative to sleeve 56, stop 94 is moved closer to fixed stop 96 thereby shortening the axial stroke of the rod 64 and polishing arm 46. A lock ring 98 is threaded on sleeve 56 to the left of stop 94, so after the stop 94 is rotated to a desired axial position, lock ring 98 may be positioned against the end of stop 94 to lock the same in position.

As described above, because air flow through exhaust orifice 92 is restricted, rod 64 and piston 78 once pulled to the left will return at a controlled rate to the right until adjustable stop 94 engages fixed stop 96 thereby preventing further material from being removed from the end of the optic cable C. During such movement, the optic cable end is first engaged against one of the abrasive platens 14 and 16, at which time the force exerted by power spring 80 (see FIG. 2) is quite small. As rod 64 and piston 78 continue to move to the right, the force applied by spring 80 increases as air is exhausted from chamber 82 so that a maximum force is applied at the end of the stroke. In addition, by opening up the variable exhaust orifice 92, the piston 78, rod 64 and polishing arm 46 will move to the right more rapidly, and as a result the axial stroke of the optic cable end is more rapid and the force on the cable end builds up more rapidly to a maximum level.

It is important to understand the function of the springs shown at 76 and 100 in FIG. 3. The purpose of the spring 76 is to cushion the impact when the optic cable end is first engaged against one of the abrasive platens 14 or 16. As rod 64 is first pulled to the left and then moves to the right to cause the optic cable end to first engage one of the abrasive platens, rod 64 pulls knob 62 which acts through spring 76 and spring guide 74 to urge sleeve 56 and polishing arm 46 toward the abrasive platen.

Accordingly, the force pressing the optic cable end against the abrasive platen is applied through and cushioned by compression spring 76. The effect of the foregoing is that there is in effect a "zero load" when the optic cable end first touches the abrasive platen, and the force then gradually builds up to a maximum force, the rate of build-up depending upon the setting of the variable exhaust orifice 92.

The second spring 100 extends between the fixed stop 96 and the right end of the sleeve 56. The spring 100 serves as a return spring and holds the sleeve 56 to the left against the float spring guide 74. Spring 100 is a relatively light spring which readily compresses as sleeve 56 is moved to the right during a polishing operation.

The platens 14 and 16 are rotated in the directions shown in FIG. 1 during a polishing operation. In addition, in accordance with a preferred embodiment of my invention, the polishing arm 46 is oscillated back and forth across the face of one of the abrasive platens 14 or 16 during a polishing operation. Such oscillation is effected by a three-armed cam shown at 18 in FIG. 1. There are two elongated cam follower rollers 102 and 104 secured to the polishing arm 46 in side-by-side relation. When the arm 46 is in the position shown in FIG. 1, cam follower 104 cooperates with cam 18. The cam 18 is mounted for rotation on a shaft 106 which is driven from motor 108 in a clockwise direction as viewed in FIG. 1.

As cam 18 rotates in a clockwise direction, one of the cam arms engages cam follower 104 and swings arm 46 in a clockwise direction until the tip of the cam arm passes beyond follower 104, after which the polishing arm 46 moves back under force of gravity in a counterclockwise direction under the control of the opposite side of the cam arm. The three cam arms act in sequence on the follower 104 to continually oscillate the polishing arm 46 back and forth, thereby causing the end of the optic cable C to be oscillated back and forth across the face of the rotating abrasive platen 14 during a polishing operation.

When it is desired to use the other abrasive platen 16 to polish the end of the optic cable C, it is a simple matter to take the polishing arm 46 and swing it around in a clockwise direction from the position shown in FIG. 1 and in solid lines in FIG. 6 to the position shown in dash lines in FIG. 6. In the latter position, the other cam follower 102 cooperates with cam 18 in the same manner described above, so that the cam moves the arm 46 in a counterclockwise direction as shown in FIG. 6, and gravity will return the arm thereby repeatedly oscillating the end of an optic cable back and forth across the face of abrasive platen 16.

It will now be seen that by rotating the platens 14 and 16 in the opposite directions shown by the arrows in FIGS. 1 and 6, the force exerted on polishing arm 46 by a rotating platen will urge the respective cam follower 102 or 104 into engagement with the cam 18 thereby improving the cooperation between arm 46 and drive cam 18.

As previously described, the two platens 14 and 16 may be used respectively for rough polishing and finish polishing by using different grades of abrasive. Another feature of the invention is to offset one of the platens slightly forwardly of the other as viewed in FIG. 5. Since the amount of the desired offset is slight, it cannot be illustrated in the drawings. However, the concept is to mount that platen used for finish polishing slightly ahead of the platen used for rough polishing. Thus, if platen 14 is used for rough polishing or grinding, the platen 16 is preferably offset ahead of platen 14 by a distance of 0.0001 inch to 0.005 inch.

With such an offset, the adjustable stop 94 may be set in a desired position to control the amount of material removed from the end of an optic cable during a rough polishing or grinding operation on platen 14. After completion of the rough polishing or grinding operation, polishing arm 46 may be swung around to the position shown in dash lines in FIG. 6, and the finish polishing operation may then be carried out on platen 16 without changing the position of stop 94. By such a procedure, the amount of material removed from the end of the optic cable during the finish polishing operation will be equal to the predetermined amount of offset described above. The apparatus of the present invention is well suited for grinding and polishing the ends of fiber optic connectors where a glass or ceramic type optic fiber is used. The first contact by the grinding or polishing medium is accomplished very gently to avoid splintering or fracturing of the fiber. After the first sharp edges are removed, the grinding pressure is increased so as to avoid plucking or pitting in the end surface of the fiber. The apparatus of the present invention provides a slow, soft and resilient start as the fiber optic end first contacts an abrasive medium, and thereafter the axial grinding force increases with time, the rate of increase being adjustable as desired.

It will further be understood that the arm 46 and fixture 48 may be designed to hold a plurality of fiber optic ends so that several such optic cable ends may be ground or polished in a single operation.

It is a further advantage of the invention that the motor 108 which drives the cam 18 is independent of the platen drive motor 34. The independence of the cam 18 to the platen drive permits almost all of the abrasive material on the platen to be used in polishing the optic end, and as a result a repeatable wear pattern on the abrasive is avoided.

What is claimed is:

1. Apparatus for polishing the end of a fiber optic member comprising, in combination, movable polishing means having an abrasive surface for polishing said fiber optic member when the latter is urged into engagement with said abrasive surface, movable support means for holding said fiber optic member and advancing the same into engagement with said abrasive surface, and force-applying means for controlling the movement of said movable support means toward said abrasive surface, said force-applying means including first means for applying a force to said movable support means toward said abrasive surface, and second means comprising compressible means between said first means and said movable support means, whereby upon operation of said force-applying means said fiber optic will initially engage said abrasive surface with a relatively low force which gradually increases to a maximum as said force-applying means continues to advance said movable support means toward said abrasive surface and thereby compresses said second means.

2. Apparatus as defined in claim 1 where said first means comprises compression spring means which is manually compressed to initiate operation of said force-applying means.

3. Apparatus as defined in claim 1 where said first means comprises rod means in conjunction with compression spring means, said compression spring means being manually compressed to initiate movement of said rod means to advance said movable support means toward said abrasive surface.

4. Apparatus as defined in claim 3 including an air cylinder having a piston therein connected with one end of said rod means, said compression spring means being positioned in said air cylinder to urge said piston and rod means in a predetermined direction causing said movable support means to advance toward said abrasive surface, said air cylinder being associated with a variable orifice to control exhausting of air from said air cylinder when said pistion and rod means are moved in said predetermined direction, said force-applying means being actuated by manually pulling said rod means in a direction opposite said predetermined direction to compress said compression spring means.

5. Apparatus for polishing the end of a fiber optic member comprising, in combination, movable polishing means having an abrasive surface for polishing said fiber optic member when the latter is urged into engagement with said abrasive surface, movable support means for holding said fiber optic member and advancing the said into engagement with said abrasive surface, and force-applying means for controlling the movement of said support means toward said abrasive surface, said force-applying means including first means for applying a force to said movable support means toward said abrasive surface, and second means comprising compressible means between said first means and said movable support means, said movable polishing means comprising a rotatable platen having an abrasive surface, and said movable support means comprising an arm which oscillates back and forth about an axis parallel to the axis of said platen whereby upon operation of said force-applying means said arm will initially engage said fiber optic against said abrasive surface with a relatively lower force which gradually increases to a maximum as said force-applying means continues to advance said arm toward said abrasive surface and whereby compresses said second means.

6. Apparatus as defined in claim 5 including stop means associated with said support means for limiting the travel of said arm toward said abrasive surface.

7. Apparatus as defined in claim 6 where said movable polishing means comprises a pair of rotatable platens each having an abrasive surface, said pair of platens being positioned in generally side-by-side relation with one platen positioned slightly forward of the other, said arm being manually movable into a seleeted positions for cooperation with a selected one of said pair of platens, the forwardly positioned platen being used for finishing said fiber optic and the other platen being used for preliminary polishing of said fiber optic.

8. Apparatus for polishing the end of a fiber optic member comprising, in combination, a rotatable platen having an abrasive surface for polishing said fiber optic member when the latter is urged into engagement with said abrasive surface, movable arm means for holding said fiber optic member and advancing the same into engagement with said abrasive surface, sadi movable arm means being oscillatable back and forth aoross said abrasive surface, and force-applying means for controlling the movement of said movable arm means toward said abrasive surface said force-applying means including rod means associated with said movable arm means for moving the same toward said abrasive surface, compressible means interposed between said, rod means and said movable arm means, and means for actuating said rod means to move the same and thereby advance said movable arm means toward said abrasive surface, whereby said fiber optic will initially engage said abrasive surface with a relatively low force which gradually increases to a maximum as said rod means continues to advance said movable arm means toward said abrasive surface thereby compressing said compressible means.

9. Apparatus as defined in claim 8 where said compressible means comprises a compression spring.

10. Apparatus as defined in claim 8 where said means for actuating said rod means comprises an air cylinder having a piston therein, said rod means having one end connected with said pistion, and compression spring means in said air cylinder biasing said rod means in a first direction causing said movable arm means to move toward said abrasive surface, said air cylinder being associated with a variable orifice to control exhausting of air from said air cylinder when said piston and rod means are moved in said first direction by said compression spring means, said force-applying means being actuated by manually pulling said rod means in a direction opposite to said first direction to compress said compression spring means.

11. Apparatus for polishing the end of a fiber optic member comprising, in combination, first and second rotatable platens each having an abrasive surface and positioned in generally side-by-side relation, movable arm means for holding said fiber optic member and advancing the same into engagement with a selected one of said first and second rotatable platens, said movable arm means being movable along an axis parallel to the axes of said first and second platens and being swingable back and forth about said axis to oscillate said fiber optic member across a selected one of said platens, means for rotating said first and second platens, force-applying means for advancing said movable arm means axially toward a selected one of said platens, and common cam means positioned between said first and second rotatable platens, said movable arm means having cam follower means secured thereto, said movable arm means being manually swingable in one direction about said axis until said cam follower means is in a first position in operative engagement with one side of said common cam means and also being manually swingable in the opposite direction until said cam follower means is in a second position in engagement with the other side of said common cam means, said common cam means serving to oscillate said fiber optic member across said first platen when said movable arm means is in said first position and to oscillate said fiber optic member across said second platen when said movable arm means is in said second position.

12. Apparatus as defined in claim 11 where said first and second platens are rotated in opposite directions, the direction of rotation of each of said platens being to bias said cam follower means toward said common cam means said movable arm means being oriented generally downwardly whereby in either of said first and second arm positions said common cam means will force said arm upwardly and said arm will return downwardly by gravity thereby oscillating said fiber optic member across a selected one of said first and second platens.

13. Apparatus as defined in claim 11 inculding stop means for controlling the axial movement of said movable arm means toward a selected one of said first and second platens.

14. Apparatus as defined in claim 13 where one of said first and second platens is positioned forwardly of the other, the forwardly positioned platen being used for finishing said fiber optic member and the other platen being used for preliminary polishing of said fiber optic member.

15. Apparatus as defined in claim 11 where said cam means comprises a rotatable cam having three equally spaced projecting cam arms.

16. Apparatus for polishing the end of a fiber optic member comprising, in combination, first and second rotatable platens each having an abrasive surface and positioned in generally side-by-side relation, movable arm means for holding said fiber optic member and advancing the same into engagement with a selected one of said first and second rotatable platens, said movable arm means being movable along an axis parallel to the axes of said first and second platens and being swingable back and forth about said axis to oscillate said fiber optic member across a selected one of said platens, means for rotating said first and second platens, force-applying means for advancing said movable arm means axially toward a selected one of said platens, and common cam means positioned between said first and second rotatable platens, said movable arm means having cam follower means secured thereto, said movable arm means being manually swingable in one direction about said axis until said cam follower means is in a first position in operative engagement with one side of said common cam means and also benig manually swingable in the opposite direction until said cam follower means is in a second position in operative engagement with the other side of said common cam means, said common cam means serving to oscillate said fiber optic member across said first platen when said movable arm means is in said first position and to oscillate said fiber optic member across said second platen when said movable arm means is in said second position, said first and second platens being rotated in opposite directions to bias said cam follower means toward said common cam means in each of said first and second positions of said movable arm means, said movable arm means being oriented generally downwardly whereby in either of said first and second arm positions said common cam means will force said arm upwardly and said arm will return downwardly by gravity thereby oscillating said fiber optic member across a selected one of said first and second platens, and one of said first and second platens being positioned forwardly of the other, the forwardly positioned platen being used for finishing said fiber optic member and the other platen being used for preliminary polishing of said fiber optic member.

17. Apparatus as defined in claim 16 where said cam means comprises a rotatable cam having three equally spaced projecting cam arms.

* * * * *